US006594465B2

(12) United States Patent
Rohde et al.

(10) Patent No.: US 6,594,465 B2
(45) Date of Patent: Jul. 15, 2003

(54) RADIATION UNIT FOR A FIXATION DEVICE

(75) Inventors: Domingo Rohde, Kiel (DE); Gerhard Bartscher, Köln (DE); Frank-Michael Morgenweck, Molfsee (DE); Detlef Schulze-Hagenest, Molfsee (DE); Douglas Kostyk, Victor, NY (US); Dinesh Tyagi, Fairport, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/015,995

(22) Filed: Dec. 6, 2001

(65) Prior Publication Data

US 2002/0106227 A1 Aug. 8, 2002

(30) Foreign Application Priority Data

Dec. 22, 2000 (DE) ..... 100 64 570

(51) Int. Cl.[7] ..... G03G 15/20

(52) U.S. Cl. ..... 399/336; 219/216; 219/388; 430/124

(58) Field of Search ..... 399/336, 335, 399/320; 219/216, 388; 430/124, 97

(56) References Cited

U.S. PATENT DOCUMENTS

| | | | | | |
|---|---|---|---|---|---|
| 3,584,195 | A | * | 6/1971 | Vince | 219/388 |
| 3,657,508 | A | * | 4/1972 | Studnick | 219/85.13 |
| 4,408,400 | A | * | 10/1983 | Colapinto | 219/388 X |
| 4,434,562 | A | * | 3/1984 | Bubley et al. | 219/388 X |
| 4,820,906 | A | * | 4/1989 | Stultz | 219/405 |
| 5,045,697 | A | * | 9/1991 | Schneider | 219/216 X |
| 5,448,344 | A | * | 9/1995 | Itakura et al. | 399/336 |
| 5,521,689 | A | | 5/1996 | Miyakoshi | 399/336 |
| 5,887,238 | A | | 3/1999 | Matsuzoe et al. | 399/336 |
| 6,461,782 | B1 | * | 10/2002 | Sasada et al. | 430/124 X |

FOREIGN PATENT DOCUMENTS

| | | | |
|---|---|---|---|
| JP | 57-105761 | * | 7/1982 |
| JP | 60-209775 | * | 10/1985 |
| JP | 04-191877 | * | 7/1992 |
| JP | 2001-188426 | * | 7/2001 |

* cited by examiner

*Primary Examiner*—Sophia S. Chen
(74) *Attorney, Agent, or Firm*—Lawrence P. Kessler

(57) ABSTRACT

A radiation unit for a fixation device for fixation of toner material on a printing stock surface for an electrophotographic printing machine, as well as a method for exposure and fixation of toner material on a printing stock surface. Exposure for fixation of toner material occurs essentially indirectly, i.e., the light emitted by the radiation unit is reflected at least once, so that high uniformity and homogeneity of the radiation, efficient energy utilization and avoidance of adverse changes on the printing stock are achieved. A high-energy density, low housing dimensions and independence of the radiation from the employed printing unit are achieved by the fact that the radiation wavelength lies essentially in the ultraviolet spectral range.

18 Claims, 3 Drawing Sheets

RADIATION UNIT FOR A FIXATION DEVICE

FIELD OF THE INVENTION

The invention concerns a radiation unit for a fixation device to fix toner material on a printed stock surface for an electrophotographic printer according to a method for exposure and fixation of toner material on a printing stock surface.

BACKGROUND OF THE INVENTION

In electrostatic printing a latent image is produced on the surface of a cylinder (photoconductor drum) coated with a photoconductor material. Toner material applied by means of a development station adheres to the electrostatically charged areas of the photoconductor drum, which represent the latent image. The developed latent image is transferred in a subsequent step to a printed stock surface guided along the photoconductor drum. Another variant transfers the developed latent image only to an intermediate carrier and from this to the printed stock surface. Because of this, the developed latent image is made visible and imaged on the printed stock surface.

The application and fixation process, as well as the cooling times of the toner material, are problems, among other things, which must be considered, in order to avoid wiping off of image parts and undesired lengthening or disturbance of the printing process. Different solution proposals to prepare fixation devices for fixation of toner material on the printed stock surface have therefore been offered. Methods were developed that avoid the drawbacks of fixation by contact with the printed stock surface by means of radiation.

U.S. Pat. No. 5,526,108 describes an "electrostatographic" printer with an image station to image a latent electrostatic image on the surface of the cylinder, a toner developer station for development of the latent image, in order to produce a toner image, and a toner transfer station to transfer the toner image to a moving surface. The invention also includes a fixation station to fix the toner image on the printing stock surface, consisting of two pairs of radiating heat sources, in which the wavelength with the maximum energy delivery lies in the infrared spectral range. The temperature of the heat sources lies in the range from 150° C. to 300° C.

European Patent Application No. EP 0 992 864 discloses fixation of an ink on a sheet-like and/or endless support, especially toner powder on copier paper and/or laser printing paper, in which the ink is heated, in order to achieve a permanent bonding with the support, and especially cross-linking of the toner. In this case, the ink is exposed to infrared radiation, especially an infrared lamp at emission temperatures of 2500K or higher, so that the ink is heated by absorption of at least part of the infrared radiation and fixed. EP 0 992 864 discloses no ink-independent fixation and the disclosed ink fixation is therefore usable for color printing only with additional absorber materials in the toner material, during whose application shortcomings occur in color space and triboelectric behavior (see page 6, lines 14–28). Another shortcoming in both of the aforementioned methods are the low radiation powers and the resulting large dimensions of the radiation units.

When radiation is used on a printing stock surface, the problem of radiation homogeneity exists, among other things, i.e., the printing stock surface is exposed unequally.

Because of this, energy losses occur, since fractions of the toner material are sometimes exposed more than necessary for fixation, while other fractions of the toner material are still not sufficiently fixed. Because of the increased energy effect on fractions of the printing stock, the structure and color of the more strongly exposed printing stock surface can also be altered up to printing stock curling, lifting of the printing stock surface from the printing stock and deviations of the desired color fraction and spot formation of the printing stock.

SUMMARY OF THE INVENTION

A task of the invention is to offer a compact radiation unit for a fixation device for fixation of colored and black toner material on a printing stock surface in a printer. Another task of the invention is to avoid structural changes, color changes, printing stock curling, lifting of the printing stock surface from the printing stock, deviations of the desired color fraction and spot formation on the printing stock. Another task of the invention is to offer a radiation unit that fixes toner material on the printing stock independently of color. According to the invention, a radiation unit for a fixation device for fixation of toner powder for an electrophotographic printer is proposed, in which the radiation wavelength lies essentially in the ultraviolet range and includes at least one reflector. By high power densities in the ultraviolet spectral range and appropriate reflection, a radiation unit is offered for the first time with high power and relatively small dimensions. By using quartz glass as bulb material of the radiator of the radiation unit, the radiation in the ultraviolet C range is only slightly attenuated, since quartz glass has low absorption in the ultraviolet (UV) range, i.e., the wavelength range from 200 nm to 380 nm. As an alternative to quartz glass, other UV-transparent materials, like, sapphire, can be used as bulb material. Advantageously, the employed radiator can be a mercury radiator of high power with an operating voltage per unit length in the range from about 70 V/cm to 15 V/cm, in which the mercury radiator delivers the desired radiation wavelength cost-effectively and efficiently.

The power of the radiator (10, 11, 100) is adjustable in the range from 20% to 100% of its nominal power and the radiator can be operated for a period of less than 10 seconds even with a power of 200%, if the power delivery averaged over a longer period does not exceed 100%.

The reflector connected to the radiation unit is either symmetrical or asymmetrical. The asymmetric reflector is particularly advantageous for fixation of specific toner materials.

A grid or screen-like diaphragm can be arranged in front of the radiator, which homogenizes the non-homogeneous intensity profile of the emitted light produced by the radiation unit in the direction of the radiator bulb and therefore adjusts it to the application purpose. Light reflection can be present in the middle of the diaphragm that is stronger in comparison with the ends.

According to the invention, radiation to fix the toner material occurs essentially indirectly, i.e., the light emitted by the radiation unit is reflected at least once, so that high uniformity and homogeneity of the radiation and avoidance of adverse changes on the printing stock are achieved.

The radiation unit can have at least two radiators, each with at least one reflector, arranged on opposite sides, between which a conveyor belt with the printing stock is arranged. The toner material is therefore advantageously exposed uniformly by two radiators, each with one reflector, in which reflection of the radiation can be diffuse and/or directed. Because of this, two-sided essentially reflected exposure of the printing stock is then possible.

An additional reflector can also be mounted in the radiation unit. By means of this variant, the fire hazard in the radiation unit is also reduced, since this arrangement of the radiator and reflectors has a more limited risk, in comparison with the prior art, that, in the case of a paper jam in the printer, for example, the printing stock will come in contact with the hot radiators and hot reflectors.

An additional reflector is arranged above the conveyor belt to increase energy utilization, which is flat and covers the space above the conveyor belt, so that a higher percentage of the radiation falling on the additional reflector is reflected in the direction of the printing stock.

The reflectors and/or the conveyor belt contain a heat-resistant material to guarantee their longer lifetime, to avoid radiation damage from the high-energy radiation and a significant reduction in fire hazard. The reflectors contain or consist of Teflon®, barium sulfate and/or aluminum. The conveyor belt contains or consists of Teflon®. With particular advantage, a toner material is proposed having a sharp transition from its solid to its liquid or pasty state. In conjunction with the toner material, the ratio of the elastic modulus G' at the reference temperature value, calculated from the initial temperature at the beginning of the glass transition of the toner plus 50° C., to the value of the elastic modulus G' at the initial temperature itself, can be less than $1\times10^{-5}$, preferably even less than $1\times10^{-7}$. The initial temperature of the beginning of the glass transition of the toner material is preferably determined as that temperature value at which the tangent intersects the plot of elastic modulus G' as a function of temperature before and after the glass transition. The transition from the solid to liquid or pasty state occurs within a temperature range of about 30° K or less and between the temperature values of 70° C. and 130° C. The energy to be applied to the radiation unit is further reduced by this. When the described toner material is used, higher luster and high color saturation or color brilliance are also achieved on the image ultimately printed by the electrophotographic printer.

BRIEF DESCRIPTION OF THE DRAWINGS

The invention is now further explained by means of practical examples, in which reference is made to the accompanying drawings.

DETAILED DESCRIPTION OF THE PREFERRED EMBODIMENTS

Figure 1:
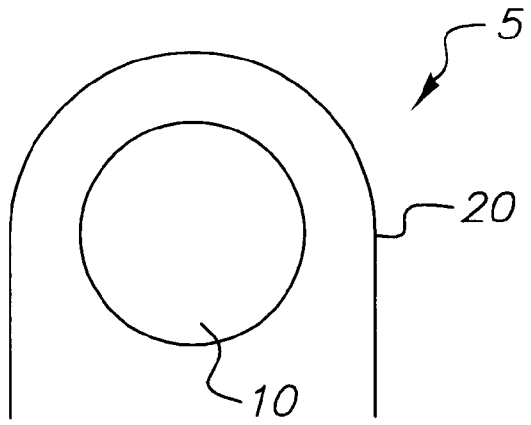
FIG. 1 shows a schematic cross section of a side view of a radiation unit with a symmetric reflector.

FIG. 1 schematically depicts a radiation unit 5, including a mercury radiator 10 and a reflector 20 and used in electrophotographic printing to melt and fix toner material 95 on printing stock 92. The radiation unit 5 is arranged above a conveyor belt, on which the corresponding printing stock 92 is conveyed with the electrostatically adhering toner material 95. The toner materials 95 of different color, used in multicolor printing, have different curve trends for absorption of radiation as a function of wavelength of the radiation. The absorption of toner materials 95 of different color is essentially equally high in the wavelength range lower than 380 nm, so that the energy absorption is essentially color-independent. By the radiation unit being a mercury radiator 10, high efficiency is achieved during conversion of electrical energy to UV radiation. Examples of manufacturers of employable radiators are Heraeus Noblelight GmbH, Kühnast Strahlungstechnik and Fusion UV Systems GmbH. The high intensity causes very effective and rapid fixation of toner material 95 on printing stock 92, for example, in comparison with exposure to light in the infrared spectral range. The radiation energy and energy utilization are further increased if the reflector 20 encloses the mercury radiator 10 on a large fraction facing away from printing stock 92 and is designed to reflect the radiation impinging on the inside of the reflector essentially in the direction of the conveyor belt with printing stock 92. In this manner, using the aforementioned features, effective fixation is achieved, regardless of the employed toner inks and printing stocks 92. When the radiation unit according to FIG. 1 is used on a printing stock surface, however, there is the problem of limited radiation homogeneity perpendicular to the direction of transport, i.e., the printing stock surface is non-uniformly exposed perpendicular to the transport direction. Because of this, energy losses occur, since fractions of the toner material 95 are sometimes exposed more than necessary for fixation, whereas other fractions of the toner material 95 are still not sufficiently fixed. In addition, because of the increased energy effect on fractions of printing stock 92, the structure and color of the more strongly exposed printing stock surface can be altered up to printing stock curling, raising of the printing stock surface from the printing stock 92 and deviations from the desired color fraction and spot formation of printing stock 92. The entire power demand of the employed radiators ordinarily lies in the range from about 5,000 to 30,000 watts.

Figure 2:
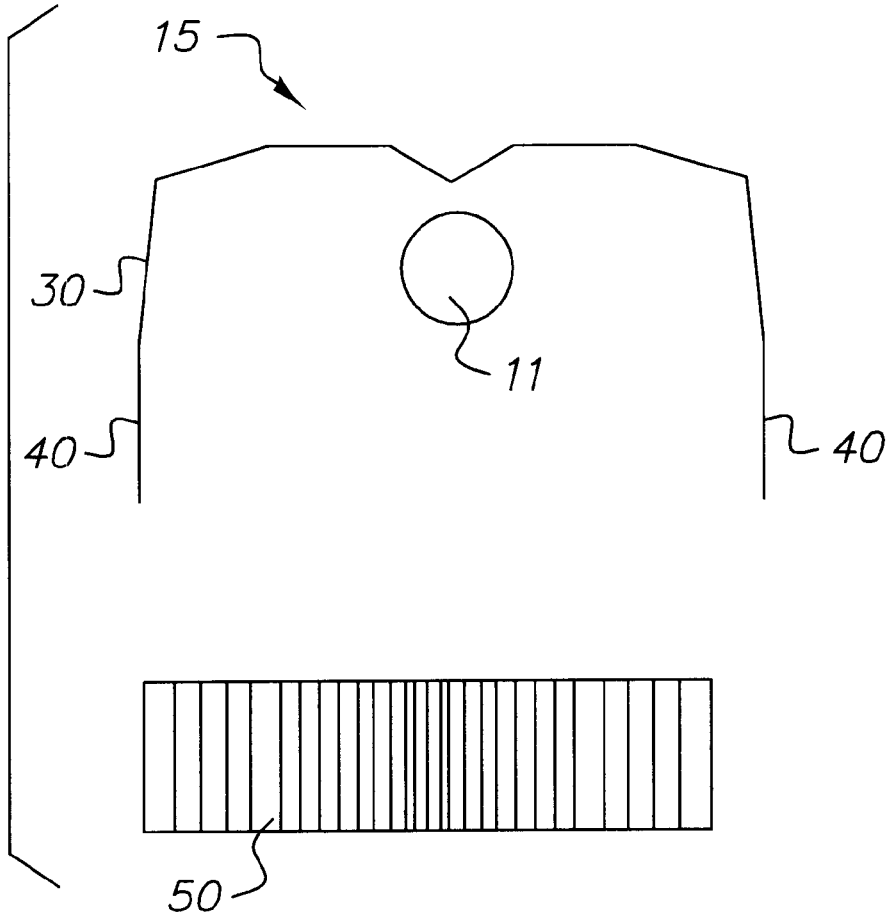
FIG. 2 shows another variant of a schematic cross section of a side view of a radiation unit with a symmetric reflector and a top view of a connected diaphragm.

FIG. 2 shows a cross section of a similar arrangement of a radiation unit 15 with a mercury radiator 10 and a point- or axially-symmetric reflector 30 arranged around it, which, with particular advantage, reflects the radiation energy of mercury radiator 10 emitted in the direction of the reflector to the printing stock 92. In comparison with the variant according to FIG. 1, the energy utilization here is further increased, since absorption of the radiation not directly emitted to the printing stock 92 occurs after a few reflections by printing stock 92 with toner material 95, because of the reflector. In addition, on the end sections of the reflector 30, at least one additional diffuse reflector 40 is mounted for reflection of scattered light not directly impinging on the printing stock 92 with toner material 95. The radiation unit according to FIG. 2 has a large emission range and a limited number of multiple reflections, because of the special geometry of reflectors 30, 40. A dimension of the radiation unit 15 was recognized as particularly effective, having a 2 cm to 20 cm greater length than the maximum width of printing stock 92 in the transport direction of conveyor belt 90. In comparison with radiation unit 5 according to FIG. 1, in the radiation unit 15 according to FIG. 2 the fraction of reflected radiation in relation to the radiation impinging directly on printing stock 92 is increased and consequently the homogeneity and uniformity of the radiation impinging on printing stock 92 is increased. Directly beneath mercury radiator 11, a grid- or screen-like diaphragm 50 is situated, which is shown in FIG. 2, so that the regions lying in the center region of diaphragm 50 with denser shading reflect the light more strongly than the regions with less dense shading, lying in the end region. Because of this, the light in the center region of radiation unit 15 is back-reflected more strongly in the radiation unit 15 than light on the edge regions, so that the printing stock 92 with toner material 95 is more uniformly exposed. The diaphragm 50 is shown in a top view for clarification here and, during operation, the diaphragm 50 runs roughly parallel to mercury radiator 11, in which the radiation impinges on the surface depicted in FIG. 2.

Figure 3A:
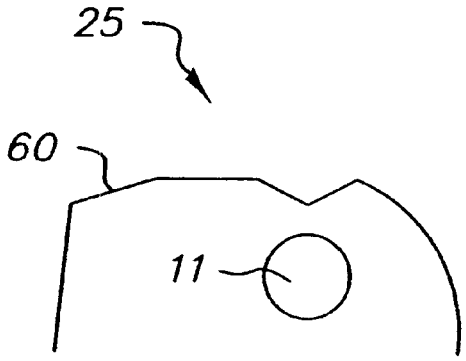
FIGS. 3A and 3B each shows a schematic cross section of a side view of a radiation unit with an asymmetric reflector.
Figure 3B:
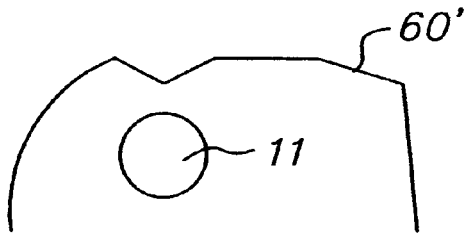

FIG. 3 shows the reflectors 60 and 60', which have an altered geometry in comparison with the aforementioned variants. The reflectors 60 and 60' in FIG. 3 are designed in a) and b) non-symmetrically. The mercury radiators 11 are arranged within the reflectors not centrally, but adjusted to the reflectors 60, with consideration of radiation reflections. The radiation range is consequently also obtained with reference to the direction perpendicular to the radiator bulb as unsymmetric. It was found that, in certain toner materials 95, an asymmetric intensity trend of the radiation intensity in the direction perpendicular to transport or advance on printing stock 92 yields better results during fixation of the toner material 95 than a symmetric intensity trend. The variant of FIG. 3 is based on this phenomenon and technically exploits it. It is therefore possible to adapt the radiation unit 25 with reference to the intensity trend to specific toner materials 95.

Figure 4:
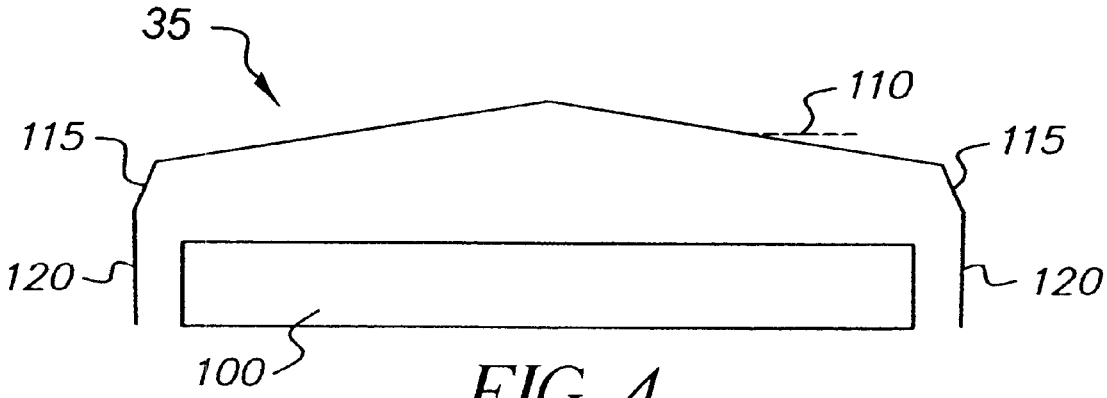
FIG. 4 shows a schematic cross section of a front view of a modification of the radiation unit.

FIG. 4 shows a variant of a radiation unit 35 for fixation of toner material 95 with a radiator 100 and a special reflector 110. The radiator has an essentially elongated shape and the reflector 110 surrounds radiator 100 essentially above and laterally and largely consists of two flat surfaces with reflector material on the inside that extend at an angle to each other and meet roughly in the center above the radiator and are arranged essentially in the form of a cross section of an obtuse-angled cone without a base surface above the radiator. On the flat surfaces to the open side, additional reflectors 115, 120 are then situated with an obtuse angle relative to the surfaces, so that the radiator 100 is essentially enclosed above and to the side by reflectors 110, 115, 120. By this radiation unit 35, a larger fraction of the radiation is reflected from the center regions of the radiation unit to the peripheral region than the reverse. Consequently, homogeneous and uniform radiation of printing stock 92 is achieved perpendicular to the transport direction of printing stock 92.

Figure 5:
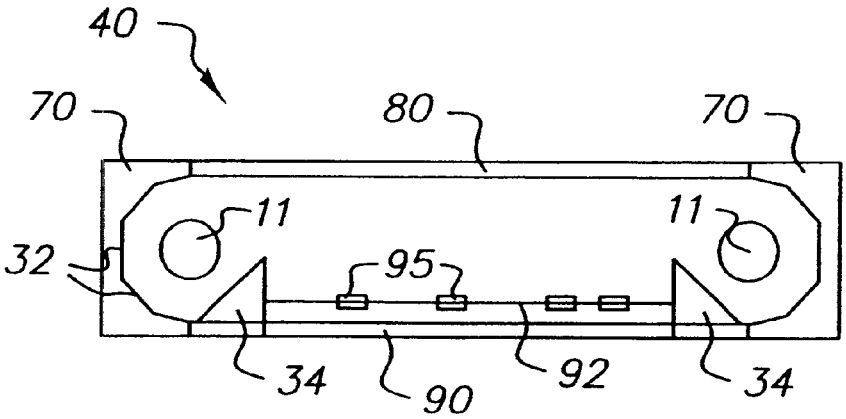
FIG. 5 shows a schematic cross section with a side view of the radiation unit with a radiator and reflector on sides arranged opposite to each other and an additional reflector for scattered light.

FIG. 5 shows a particularly advantageous variant of the invention, in which two radiators 11 that emit essentially in the ultraviolet spectrum, are arranged on opposite sides roughly at the same height. A reflector 70 is arranged around the two radiators 11, enclosing the radiator 11 roughly at a peripheral angle of 180° and being arranged roughly as mirror images of each other, so that the emission regions of radiators 11 face each other. In this example, the insides of the reflectors have a sequence of adjacent rectangular surfaces 32 that produce a more or less strongly pronounced round shape of the inside of reflectors 70, depending on the number of surfaces. The shape of the insides of reflectors 70 can also be semicircular or elliptical. A conveyor belt 90 for transport of printing stock 92, for example, paper, cardboard, foil, paperboard, is arranged between the radiators 11. The conveyor belt 90, produced from Teflon® in this example, is moved perpendicular to the viewing plane and can reflect the impinging radiation. A specific toner material 95 is depicted schematically as a rectangle and is guided through the radiation unit 40 with radiators 11 and the corresponding reflectors 70 by the conveyor belt 90 on the printing stock 92, on which it was applied in a previous process step. This specific toner material 95 has a sharp transition from its solid to liquid state when heated. An additional reflector 80 is arranged above radiators 11, conveyor belt 90 and reflectors 70. This is flat and covers the radiation unit 40 in a manner so that no radiation escapes. As is apparent in FIG. 5, additional reflectors 34 are arranged on each side of conveyor belt 90 in the vicinity of radiators 11, which, in this example, have a triangular cross section, extend in the longitudinal direction over the entire length of the radiation unit 40 and reflect radiation coming from the radiators that impinges directly on the printing stock 92 without reflection and would cause non-homogeneities of radiation intensity. In addition, the reflectors 34, with an undesired alignment of the printing stock 92 on conveyor belt 90, cause shielding of printing stock 92 from radiators 11, as is apparent, and consequently protection of the printing stock 92 from unduly strong heating. A cathetus of the triangular cross section of reflector 34 therefore preferably extends perpendicular to conveyor belt 90 upward, so that the printing stock 92 runs perpendicular to a surface reflector 34 during operation. Together, reflectors 70, reflector 80 and the conveyor belt 90 form walls of a chamber, which can be closed, with the exception of a feed for conveyor belt 90 with printing stock 92. With this largely closed structure according to FIG. 5, the radiation impinges on printing stock 92 with toner material 95 after one or more (up to several) reflections. The reflectors 70, 80 have a high reflection capacity, so that the energy losses by absorption of the reflector material can be kept small. The radiation intensity on printing stock 92 with toner material 95 is essentially constant over the entire surface of printing stock 92 in the vertical and horizontal direction to the viewing plane according to FIG. 5, in contrast to the radiation unit 5 according to FIG. 1.

Up to a temperature of about 70° C., the toner material 95 has a solid state, i.e., a high viscosity value, so that the toner material, after application and fixation on printing stock 92 adheres to it, does not smear in the cooled state and remains unchanged on contact with other objects of the printer. For this purpose, the ratio of the elastic modulus G' in toner material 95 at the reference temperature, calculated from the initial temperature at the beginning of the glass transition of the toner material plus 50° C., to the value of the elastic modulus of the initial temperature itself, is less than $1\times10^{-5}$, preferably less than $1\times10^{-7}$. The initial temperature of the glass transition is determined from the intersection of the tangent of the elastic modulus G' before and after the glass transition and, for example, lies at about 70° C. on curve 2 according to FIG. 6.

With the aforementioned variant of toner material 95 during exposure by radiator 11, in this case essentially with indirect reflected radiation, the viscosity of toner material 95 diminishes so strongly from a temperature of about 120° C., as is apparent in FIG. 6 and described below, that the toner material 95 changes from its solid to its liquid state within a small temperature range. The toner material 95 in this state is fixed on printing stock 92, in which the toner material 95 melts on the prescribed regions and is permanently combined with the printing stock 92, as schematically shown in FIG. 5.

Figure 6:
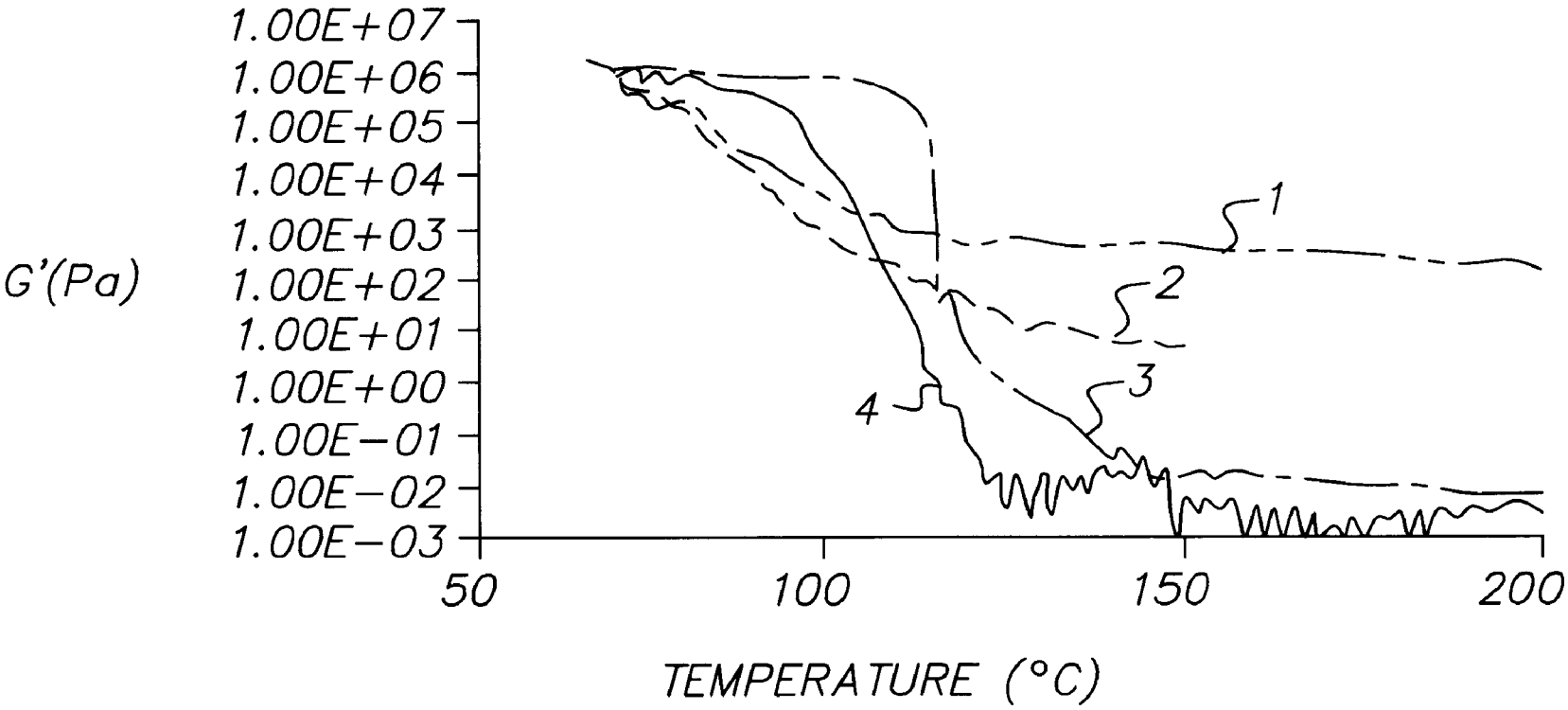
FIG. 6 shows a graph of two different toner materials in comparison with two ordinary toner materials.

Finally, FIG. 6 shows a graph of the elastic modulus G' in [Pa] as a function of temperature in degrees Celsius for two toner materials (3), (4) that are preferably used with radiation unit 5, 15, 25, 35, 40, and, as a comparison, two curve trends of ordinary toner materials (1), (2). The functional values of G' were determined by a theological measurement with a Bolin rheometer equipped with parallel plates 40 mm in diameter. A temperature scan was conducted at a frequency of 1 rad/s, corresponding to 0.16 Hz between 50° C. and 200° C. The strain of the measurement was chosen so that the sample revealed no shear dilution (Newtonian behavior). As is apparent, the ordinary toner materials (1), (2) exhibit a relatively flat curve of elastic modulus G' with increasing temperature. In contrast to this, the curves (3), (4) are almost constant over a larger temperature range than (1), (2) and then drop much more steeply than these curves and more rapidly reach elastic modulus values G' or viscosity values that are suitable for fixation of toner materials 95 on printing stock 92. A steep curve drop is particularly striking in the curve according to (3). Toner materials 95 with the curve properties depicted in (3), (4) are suitable for short exposure time and consequently small dimensions in the radiation unit (5, 15, 25, 35, 40), since only a small temperature range need be covered for fixation with the radiation; in addition, an energy saving is achieved. As is also apparent in FIG. 6, not only is the curve decline of (3), (4) stronger, but lower elastic modulus values G' are also reached, i.e., the toner material 95 becomes more liquid and has a less grainy structure in comparison with (1), (2). As a result of this, a smooth structure of the fixed toner material 95 is produced in the final image and increased color luster is achieved. Because of the absence of grain boundaries, which act as scattering surfaces or scattering centers for the radiation, the color brilliance and color saturation are increased.

In the aforementioned practical examples, a dry toner can be used that is quite hard at an average temperature of about 80° C. or about 110° C., so that it can be ground by conventional methods to a desired toner size of, say, 80 $\mu$m, and still does not melt at the development temperatures, but, at higher temperatures, suddenly becomes very fluid with low viscosity at about 110° C. or 130° C., so that is deposited, using capillarity without external pressure and without contact, on and in the printing stock and adheres to it and, on cooling, becomes hard again very quickly with good surface luster of the image on the printing stock and is fixed to it, especially because of the lack of grain boundaries of toner material 95. The latter plays a significant role for color saturation precisely in colored toner material 95.

What is claimed is:

1. Radiation unit (5, 15, 25, 35, 40) for a fixation device for fixation of toner material (95) for an electrophotographic printer, comprising: at least one radiator (10, 11, 100), whose, operating voltage per unit length lies in a range from about 7 V/cm to 15 V/cm, 60% to 80% of whose emitted radiation lies in a wavelength range lower than 380 nm, and 20% to 40% of whose emitted radiation lies in a wavelength range greater than or equal to 380 nm, and at least one reflector.

2. Radiation unit (5, 15, 25, 35, 40) according to claim 1, characterized by the fact that said at least one radiator (10, 11, 100) contains quartz glass or sapphire.

3. Radiation unit (5, 15, 25, 35, 40) according to claim 1, characterized by the fact that said at least one radiator (10, 11, 100) is operated at a power level adjustable in a range from 20% to 100% of a nominal power level, and that said power level of said radiator can be 200% of said nominal power level for a period of less than 10 seconds, if said power level averaged over a longer period does not exceed 100% of said nominal power level.

4. Radiation unit (5, 15, 25, 35, 40) according to claim 1, characterized by the fact that said at least one radiator (10, 11, 100) contains mercury.

5. Radiation unit (5, 15, 25, 35, 40) according to claim 1, characterized by the fact that at least one grid-like or screen-like diaphragm (50) having different transmission regions is arranged in said radiation unit.

6. Radiation unit (40) according to claim 1, having at least two spaced apart radiators (11), each with at least one reflector (70), between which a conveyor belt (90) with toner material (95) on printing stock (92) is arranged.

7. Radiation unit (40) according to claim 6, characterized by the fact that said at least one reflectors (70) are diffuse or specular.

8. Radiation unit (40) according to claim 6, characterized by the fact that an additional reflector (80) is arranged above said conveyor belt (90) for reflection of scattered light from said radiation unit (40), as well as said printing stock (92) and said toner material (95), said additional reflector (80) being flat and essentially covering all space above said conveyer belt (90).

9. Radiation unit (40) according to claim 8, characterized by the fact that said at least one reflectors (70), said additional reflector (80), or said conveyor belt (90) contain heat-resistant material.

10. A Radiation unit (40) according to claim 9, characterized by the fact that said heat-resistant material includes polytetrafluoroethylene.

11. Radiation unit (40) according to claim 9, characterized by the fact that said heat-resistant material includes barium sulfate.

12. Radiation unit (40) according to claim 9, characterized by the fact that said heat-resistant material includes aluminum.

13. Radiation unit (40) according to claim 8, characterized by the fact that at least one of said at least one reflectors (34,70) and/or said additional reflector (80) is symmetric.

14. Radiation unit (40) according to claim 8, characterized by the fact that at least one of said at least one reflectors (34,70) and/or said additional reflector (80) asymmetric.

15. Radiation unit (40) according to claim 6, characterized by the fact that said conveyor belt (90) contains reflective material for reflection of incident radiation.

16. Radiation unit (5, 15, 25, 35, 40) according to claim 1, characterized by the fact that a toner material (95) undergoes a sharp transition from a solid to liquid or pasty state within a 30° K temperature range.

17. Radiation unit (5, 15, 25, 35, 40) according to claim 16, characterized by the fact that said 30° K temperature range in which toner material (95) changes state is situated between the temperature values of about 70° C. and about 130° C.

18. Radiation unit (5, 15, 25, 35, 40) according to claim 17, characterized by the fact that said toner material (95) has an elastic modulus at a temperature 50° C. higher than where glass transition starts that is less than $10^{-5}$, preferably less than $10^{-7}$, of said elastic modulus at the temperature where glass transition starts.

* * * * *